US010516228B2

(12) United States Patent
Takenaga et al.

(10) Patent No.: US 10,516,228 B2
(45) Date of Patent: Dec. 24, 2019

(54) CONNECTOR HAVING A MECHANISM WHICH PREVENTS PLASTIC DEFORMATION OF A TERMINAL

(71) Applicant: JAPAN AVIATION ELECTRONICS INDUSTRY, LIMITED, Shibuya-ku, Tokyo (JP)

(72) Inventors: Yuichi Takenaga, Tokyo (JP); Akihiro Matsunaga, Tokyo (JP); Hiroaki Obikane, Tokyo (JP); Takayuki Nishimura, Tokyo (JP); Kenta Ashibu, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/029,176

(22) Filed: Jul. 6, 2018

(65) Prior Publication Data

US 2019/0074622 A1 Mar. 7, 2019

(30) Foreign Application Priority Data

Sep. 4, 2017 (JP) ..... 2017-169302

(51) Int. Cl.
*H01R 13/41* (2006.01)
*H01R 12/71* (2011.01)
*H01R 13/11* (2006.01)

(52) U.S. Cl.
CPC ..... *H01R 13/41* (2013.01); *H01R 12/716* (2013.01); *H01R 13/11* (2013.01)

(58) Field of Classification Search
CPC ..... H01R 13/41; H01R 12/716; H01R 13/11; H01R 9/096; H01R 13/22; H01R 33/18
(Continued)

(56) References Cited

U.S. PATENT DOCUMENTS 7,287,988 B1 * 10/2007 Peng ..... H01R 12/52 439/74
7,674,115 B2 3/2010 Midorikawa
(Continued)

FOREIGN PATENT DOCUMENTS

JP 2007134091 A 5/2007
JP 4454651 B2 4/2010
(Continued)

OTHER PUBLICATIONS

Taiwanese Office Action dated Jan. 31, 2019 (and English translation thereof) issued in counterpart Taiwanese Application No. 107123932.
(Continued)

*Primary Examiner* — Travis S Chambers
(74) *Attorney, Agent, or Firm* — Holtz, Holtz & Volek PC

(57) ABSTRACT

A connector is mateable with a mating connector along an upper-lower direction (Z-direction). The connector comprises a housing and a terminal. The housing has a holding portion and an upstanding portion which are apart from each other in a width direction (Y-direction). The upstanding portion has a stop portion. The terminal has a held portion held by the holding portion and a spring portion extending from the held portion. The spring portion has a base portion and an upward extending portion extending upward from the base portion. The upward extending portion has a facing portion which faces the upstanding portion in the width direction. The facing portion has a stopped portion. Under a mated state where the connector and the mating connector are mated with each other, the stop portion is located above the stopped portion and faces the stopped portion in the upper-lower direction.

8 Claims, 12 Drawing Sheets

(58) Field of Classification Search
USPC ..... 439/660, 65, 74, 732
See application file for complete search history.

(56) References Cited

U.S. PATENT DOCUMENTS

| | | | | |
|---|---|---|---|---|
| 7,748,993 | B2 | 7/2010 | Midorikawa et al. | |
| 7,748,994 | B1 * | 7/2010 | Peng | H01R 12/716 439/660 |
| RE41,473 | E * | 8/2010 | Hirata | H01R 12/716 439/660 |
| 8,845,339 | B2 | 9/2014 | Ono | |
| 9,325,103 | B2 * | 4/2016 | Arai | H01R 13/5219 |
| 9,331,410 | B2 * | 5/2016 | Obikane | H01R 13/02 |
| 9,614,308 | B2 * | 4/2017 | Ozeki | H01R 13/6581 |
| 2013/0280926 | A1 | 10/2013 | Ono | |
| 2015/0222044 | A1 * | 8/2015 | Arai | H01R 12/716 439/271 |
| 2016/0254605 | A1 * | 9/2016 | Miyazaki | H01R 12/707 439/691 |
| 2018/0323527 | A1 | 11/2018 | Ueda et al. | |

FOREIGN PATENT DOCUMENTS

| | | | |
|---|---|---|---|
| JP | 4574692 | B2 | 11/2010 |
| JP | 2017139198 | A | 8/2017 |
| TW | I475765 | B | 3/2015 |
| TW | I493796 | B | 7/2015 |
| TW | I525914 | B | 3/2016 |

OTHER PUBLICATIONS

Chinese Office Action dated Sep. 25, 2019 (and English translation thereof) issued in Chinese Application No. 201810875473.4.

* cited by examiner

CONNECTOR HAVING A MECHANISM WHICH PREVENTS PLASTIC DEFORMATION OF A TERMINAL

CROSS REFERENCE TO RELATED APPLICATIONS

This application is based on and claims priority under 35 U.S.C. § 119 to Japanese Patent Application No. JP2017-169302 filed Sep. 4, 2017, the content of which is incorporated herein in its entirety by reference.

BACKGROUND OF THE INVENTION

This invention relates to a connector which is mateable with a mating connector along an upper-lower direction.

For example, this type of connectors are disclosed in JP 4454651 B (Patent Document 1) and JP 4574692B (Patent Document 2), the contents of which are incorporated herein by reference.

Referring to FIG. 21, Patent Document 1 discloses an embodiment of a connector 92 that is mateable with a mating connector 94 along an upper-lower direction. The connector 92 comprises a housing 920 and a plurality of terminals 930 held by the housing 920. The housing 920 has a central projecting portion 922. Each of the terminals 930 has a resilient portion (spring portion) 932 and a lock projection (abutment portion) 934 provided on the spring portion 932. When the connector 92 is not mated with the mating connector 94 (not shown), the abutment portion 934 is apart from a wall surface 924 of the central projecting portion 922, and the spring portion 932 is resiliently deformable. While the mating connector 94 is removed from the connector 92, the abutment portion 934 is brought into abutment with the wall surface 924. This abutment prevents coming-off and plastic deformation of the terminal 930.

Referring to FIGS. 22 and 23, Patent Document 2 discloses a first embodiment of a connector 96 that is mateable with a mating connector 98 along an upper-lower direction. The connector 96 comprises a housing 960 and a plurality of terminals 970 held by the housing 960. The housing 960 has a central wall 962. Each of the terminals 970 has a mating portion (spring portion) 972 and a lock portion (abutment portion) 974 provided on the spring portion 972. When the connector 96 is not mated with the mating connector 98 (not shown), the abutment portion 974 is apart from a restriction surface (wall surface) 964 of the central wall 962, and the spring portion 972 is resiliently deformable. Referring to FIG. 23, while the mating connector 98 is removed from the connector 96, the abutment portion 974 is brought into abutment with the wall surface 964. This abutment prevents coming-off and plastic deformation of the terminal 970.

According to the coming-off prevention mechanism of each of Patent Document 1 and Patent Document 2, while the mating connector is removed upward from the connector, an edge surface of the abutment portion is moved in a lateral direction perpendicular to the upper-lower direction to be brought into abutment with the wall surface, so that a friction force between the edge surface of the abutment portion and the wall surface prevents coming off and plastic deformation of the terminal. However, in order to move the abutment portion laterally by a necessary distance so that the abutment portion is brought into abutment with the wall surface, it is necessary to accurately form the shape and the size of each of the housing and the terminals, and it is necessary to arrange the terminals at accurate positions relative to the housing. In other words, the coming-off prevention mechanism of each of Patent Document 1 and Patent Document 2 might malfunction because of manufacturing variation.

SUMMARY OF THE INVENTION

It is therefore an object of the present invention to provide a connector having a mechanism which prevents coming-off and plastic deformation of a terminal while allowing manufacturing variation.

An aspect of the present invention provides a connector mateable with a mating connector along an upper-lower direction. The connector comprises a housing and a plurality of terminals. The housing has a holding portion and an upstanding portion. The holding portion holds the terminals which are arranged along a first direction perpendicular to the upper-lower direction. The holding portion and the upstanding portion are apart from each other in a second direction perpendicular to both the upper-lower direction and the first direction. The upstanding portion has at least one stop portion. Each of the terminals has a held portion, a spring portion and a contact portion. Each of the held portions is held by the holding portion. For each of the terminals, the spring portion extends from the held portion and has a base portion and an upward extending portion. For each of the terminals, the upward extending portion extends upward from the base portion. For each of the terminals, the contact portion is supported by the upward extending portion. Each of the upward extending portions has a facing portion and an opposite portion. Each of the facing portions faces the upstanding portion in the second direction and has a stopped portion. For each of the terminals, the opposite portion is located opposite to the facing portion in the second direction. Under a mated state where the connector and the mating connector are mated with each other, the at least one stop portion is located above the stopped portions and faces the stopped portions in the upper-lower direction.

According to an aspect of the present invention, under the mated state where the connector and the mating connector are mated with each other, the stop portion of the housing is located above the stopped portion of the terminal and faces the stopped portion in the upper-lower direction. While the mating connector is removed from the connector, each terminal receives an upward force from the mating connector. This force moves the stopped portion upward. The thus-moved stopped portion is brought into abutment with the stop portion which faces the stopped portion, so that coming-off and plastic deformation of the terminal are prevented. According to an aspect of the present invention, while the mating connector is removed, it is unnecessary to move the stopped portion in a direction perpendicular to the upper-lower direction. Moreover, even if there are some manufacturing variations, it is easy to arrange the stopped portion so that the stopped portion faces the stop portion under the mated state. Thus, an aspect of the present invention provides a connector having a mechanism which prevents coming-off and plastic deformation of the terminal while allowing manufacturing variation.

An appreciation of the objectives of the present invention and a more complete understanding of its structure may be had by studying the following description of the preferred embodiment and by referring to the accompanying drawings.

Figure 1:
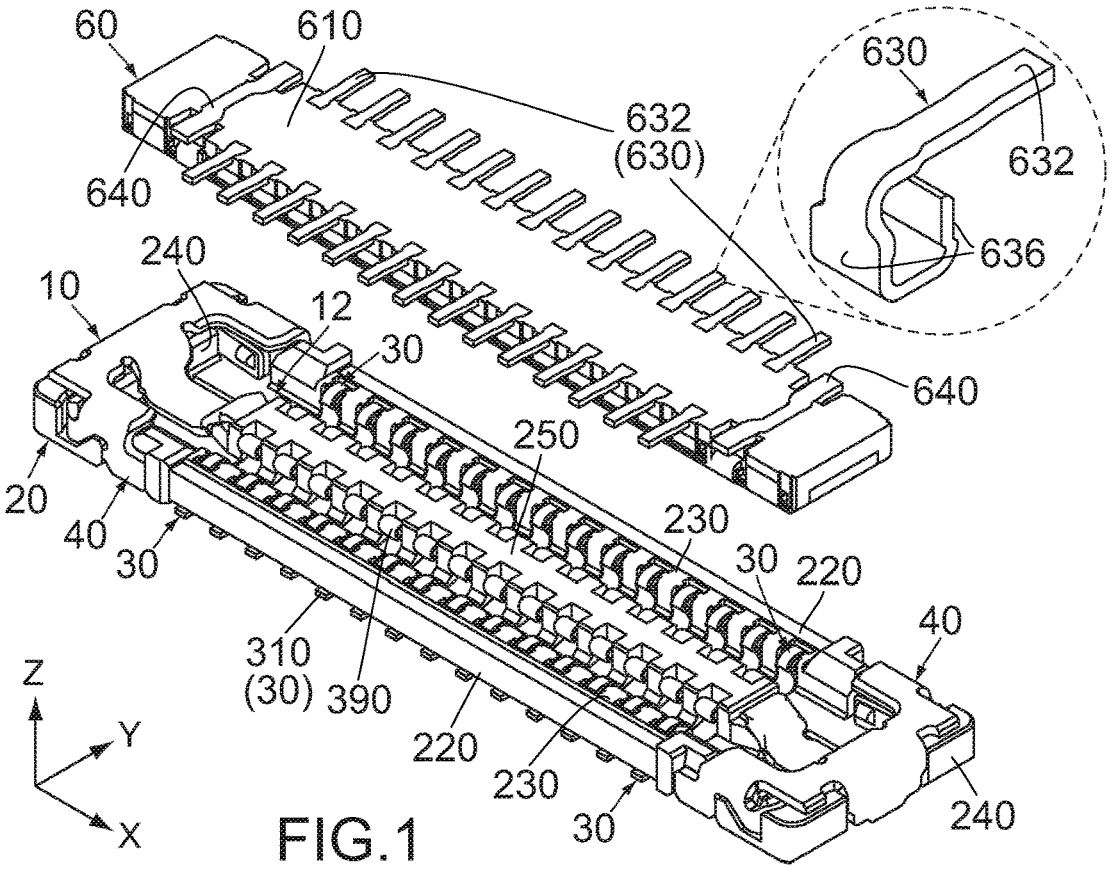
FIG. 1 is a perspective view showing a connector and a mating connector according to an embodiment of the present invention, wherein the connector is apart from the mating connector, and one of mating terminals of the mating connector is illustrated in a dashed line circle.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 17:
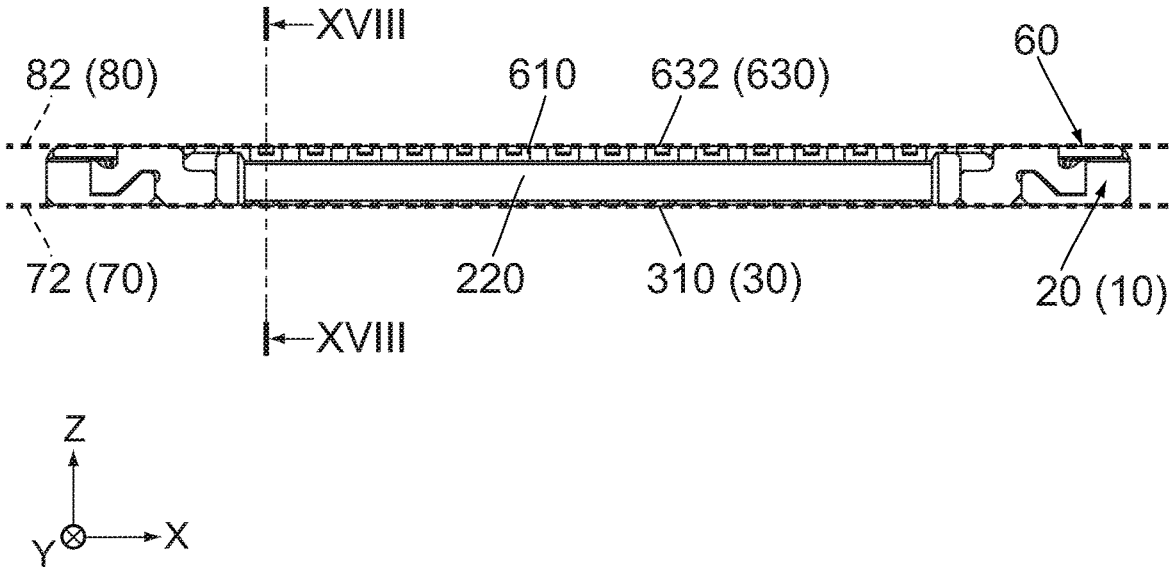
FIG. 17 is a side view showing the connector and the mating connector of FIG. 16, wherein an outline of a part of the principal surface of the circuit board and another outline of a part of the mating principal surface of the mating circuit board are illustrated in dashed line.

Referring to FIGS. 1 and 16 to 18, a connector 10 according to an embodiment of the present invention is mateable with a mating connector 60 along an upper-lower direction (Z-direction: mating direction). Referring to FIG. 17, the connector 10 is mounted on a principal surface 72 of a circuit board 70 when used, and the mating connector 60 is mounted on a mating principal surface 82 of a mating circuit board 80 when used. Thus, each of the connector 10 and the mating connector 60 is an on-board connector. Moreover, the connector 10 is a receptacle, and the mating connector 60 is a plug. However, the present invention is not limited thereto but is applicable to various connectors.

Figure 2:
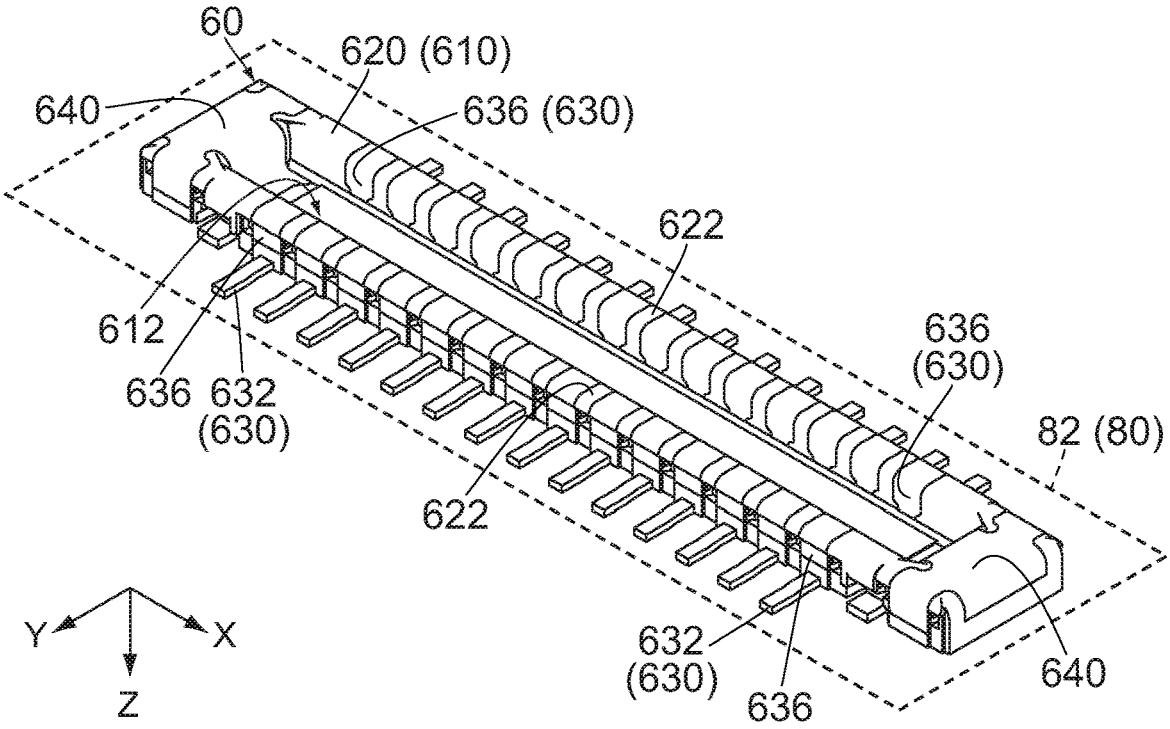
FIG. 2 is a perspective view showing the mating connector of FIG. 1, wherein the mating connector is mounted on a mating principal surface of a mating circuit board, and an outline of a part of the mating principal surface is illustrated in dashed line.

Referring to FIGS. 1 and 2, the mating connector 60 comprises a mating housing 610 made of insulator, a plurality of mating terminals 630 each made of conductor and two mating holddowns 640 each made of metal.

Referring to FIG. 2, the mating housing 610 has a mating receiving portion 612 and a peripheral wall 620. The mating receiving portion 612 is a space enclosed by the peripheral wall 620 in the XY-plane. The peripheral wall 620 has two mating holding portions 622. Each of the mating holding portions 622 holds the mating terminals 630 which are arranged along a pitch direction (X-direction: first direction). Referring to FIGS. 1 and 2, each of the mating terminals 630 has a mating fixed portion 632 and a mating contact portion 636. When the mating connector 60 is used, each of the mating fixed portions 632 is fixed to a conductive pad (not shown) of the mating principal surface 82 via soldering, etc. Each of the mating contact portions 636 is exposed to the inside of the mating receiving portion 612 and to the outside of the mating housing 610. The two mating holddowns 640 are attached to opposite ends of the peripheral wall 620 in the X-direction, respectively.

Referring to FIG. 1, the connector 10 according to the present embodiment comprises a housing 20 made of insulator, a plurality of terminals 30 each made of conductor and two holddowns 40 each made of metal.

As shown in FIGS. 3 to 7, the housing 20 has a bottom portion 210, two sidewalls 220, two holding portions 230, two end walls 240 and an upstanding portion 250. The bottom portion 210 is located at a lower end, or the negative Z-side end, of the housing 20. The two sidewalls 220 extend in parallel to each other along the X-direction. The holding portions 230 are provided so as to correspond to the sidewalls 220, respectively. Each of the holding portions 230 is located inward of the corresponding sidewall 220 in a width direction (Y-direction: second direction). The end walls 240 are located at opposite ends of the housing 20 in the X-direction, respectively. The upstanding portion 250 is located at the middle of the housing 20 in the Y-direction and extends in the X-direction.

Referring to FIG. 1, each of the terminals 30 is press-fit into and held by a corresponding one of the holding portions 230 of the housing 20 and extends toward the upstanding portion 250 in the Y-direction. The two holddowns 40 are attached to the end walls 240, respectively.

Figure 18:
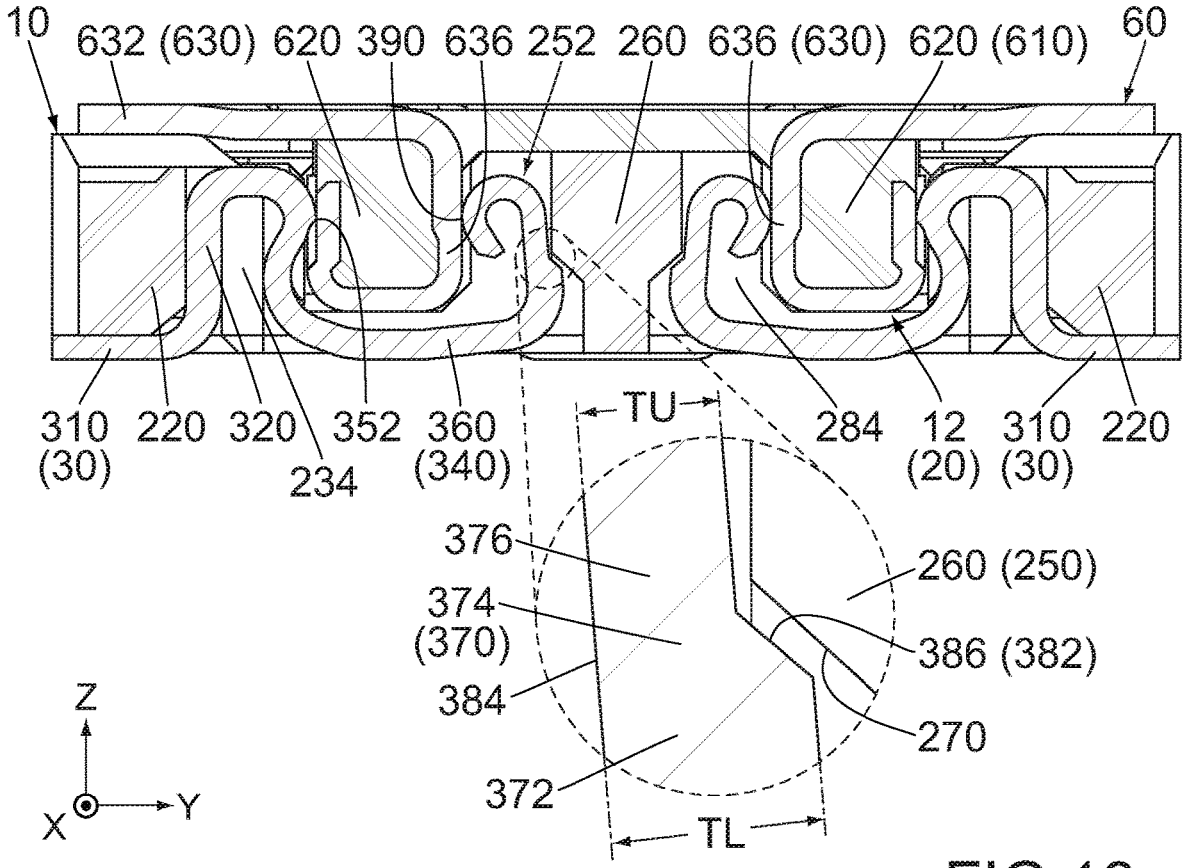
FIG. 18 is a cross-sectional view showing the connector and the mating connector of FIG. 17, taken along line XVIII-XVIII, wherein a part of the connector enclosed by dashed line is enlarged to be illustrated.

The connector 10 is formed with a receiving portion 12. The receiving portion 12 is a recess which is recessed downward, or in the negative Z-direction. The receiving portion 12 is enclosed by the sidewalls 220 and the end walls 240 in the XY-plane and encloses the upstanding portion 250 in the XY-plane. Each of the holding portions 230 and the upstanding portion 250 are apart from each other across the receiving portion 12 in the Y-direction. Referring to FIGS. 1, 2 and 18, when the connector 10 is mated with the mating connector 60, the peripheral wall 620 of the mating connector 60 is received in the receiving portion 12 of the connector 10, and the upstanding portion 250 of the connector 10 is received in the mating receiving portion 612 of the mating connector 60.

Referring to FIG. 1, the connector 10 according to the present embodiment has the aforementioned structure and, as a whole, has a box-like shape which is long in the X-direction and short in the Y-direction. However, the present invention is not limited thereto, but the connector 10 can be variously modified, provide that the connector 10 is mateable with the mating connector 60. For example, the connector 10 may comprise no holddown 40. Instead, the connector 10 may comprise various members in addition to the aforementioned members. Moreover, the housing 20 may have only one set of the sidewall 220 and the holding portion 230.

Hereafter, more detailed explanation will be made about the housing 20 (in particular, about the holding portions 230 and the upstanding portion 250) and the terminals 30 of the connector 10.

As shown in FIGS. 3 to 6, each of the holding portions 230 has a plurality of holding grooves 232 and a plurality of stop walls 234.

Each of the holding grooves 232 is a groove which is provided in the holding portion 230 to extend in the Z-direction. Each of the holding grooves 232 opens upward, or in the positive Z-direction, opens downward and opens toward the upstanding portion 250, or inward in the Y-direction. For each of the holding grooves 232, two stop walls 234 of the holding portion 230 are formed to be located inward of the holding groove 232 in the Y-direction and to protrude toward the holding groove 232 in the X-direction. Thus, each of the holding grooves 232 is provided with the two stop walls 234 which are located between the holding groove 232 and the receiving portion 12.

Figure 3:
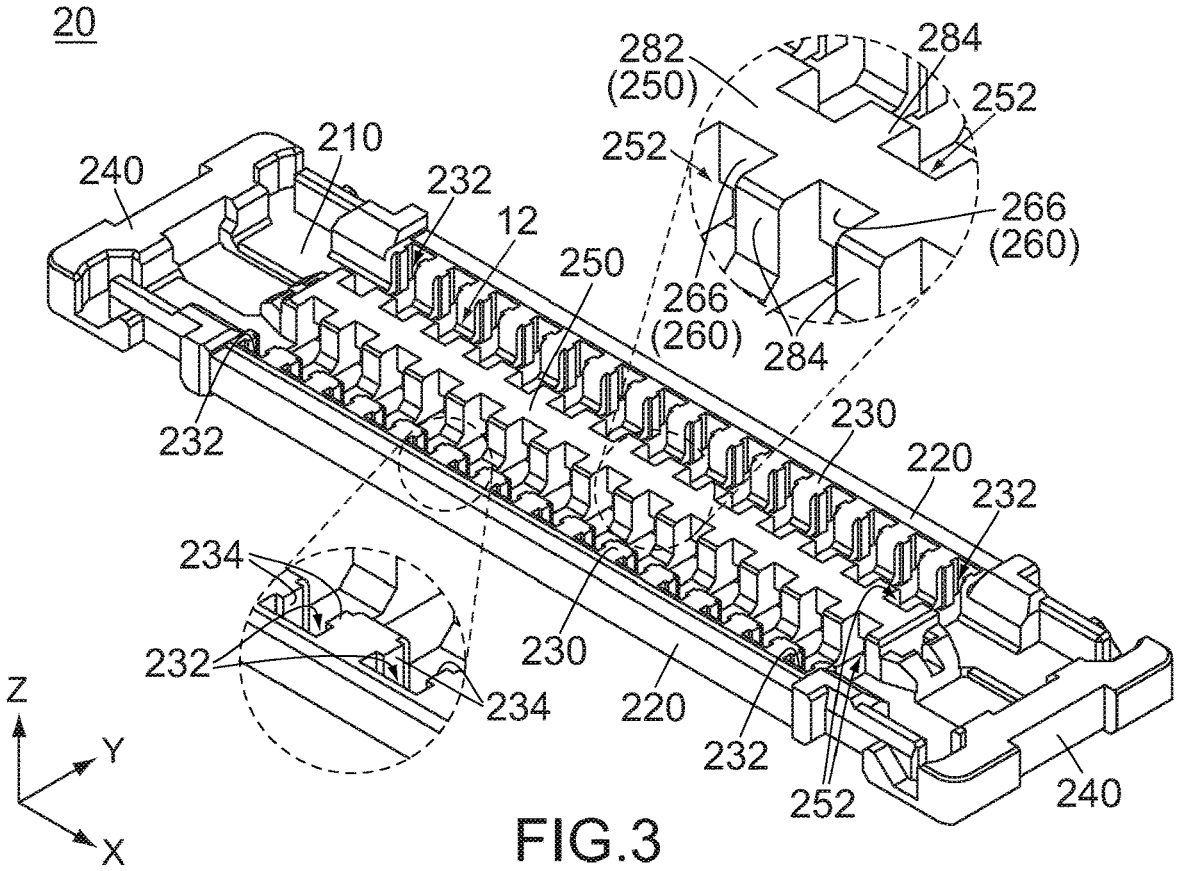
FIG. 3 is a perspective view showing a housing of the connector of FIG. 1, wherein two parts of the housing each enclosed by dashed line are enlarged to be illustrated.
Figure 5:
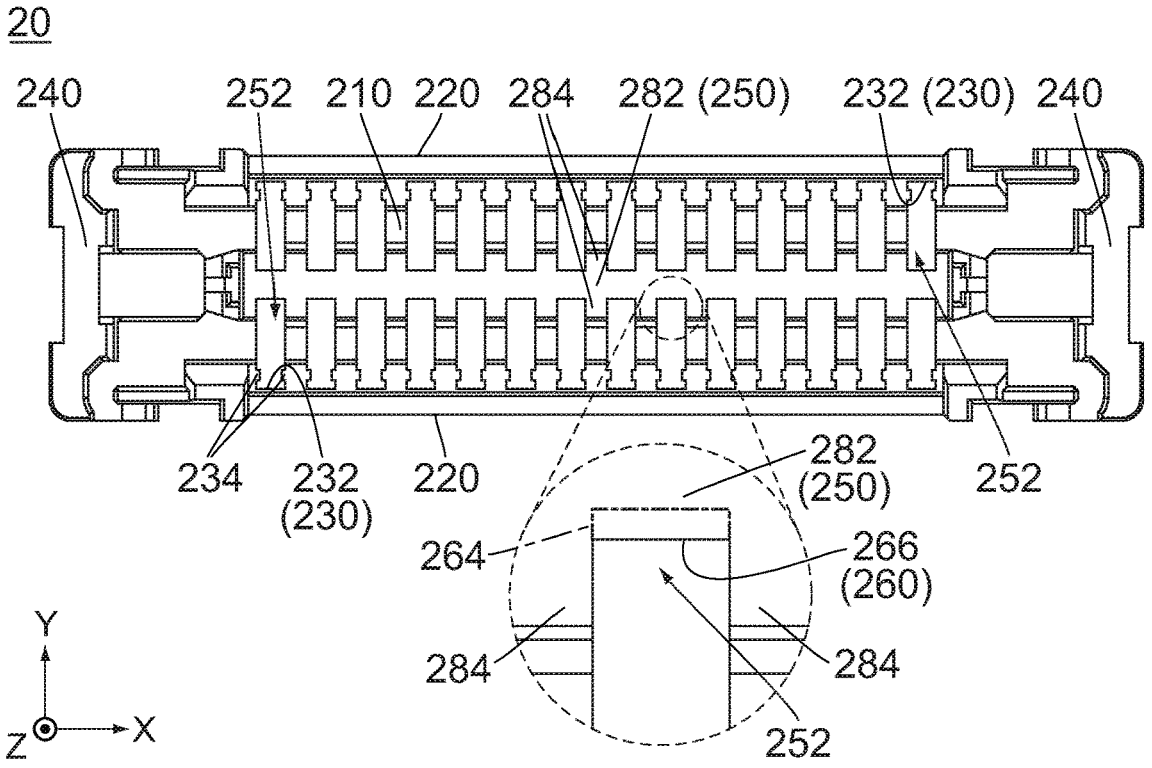
FIG. 5 is a top view showing the housing of FIG. 3, wherein a part of the housing enclosed by dashed line is enlarged to be illustrated, and in the enlarged view, an outline of a hidden mid-wall is illustrated in chain dotted line.
Figure 6:
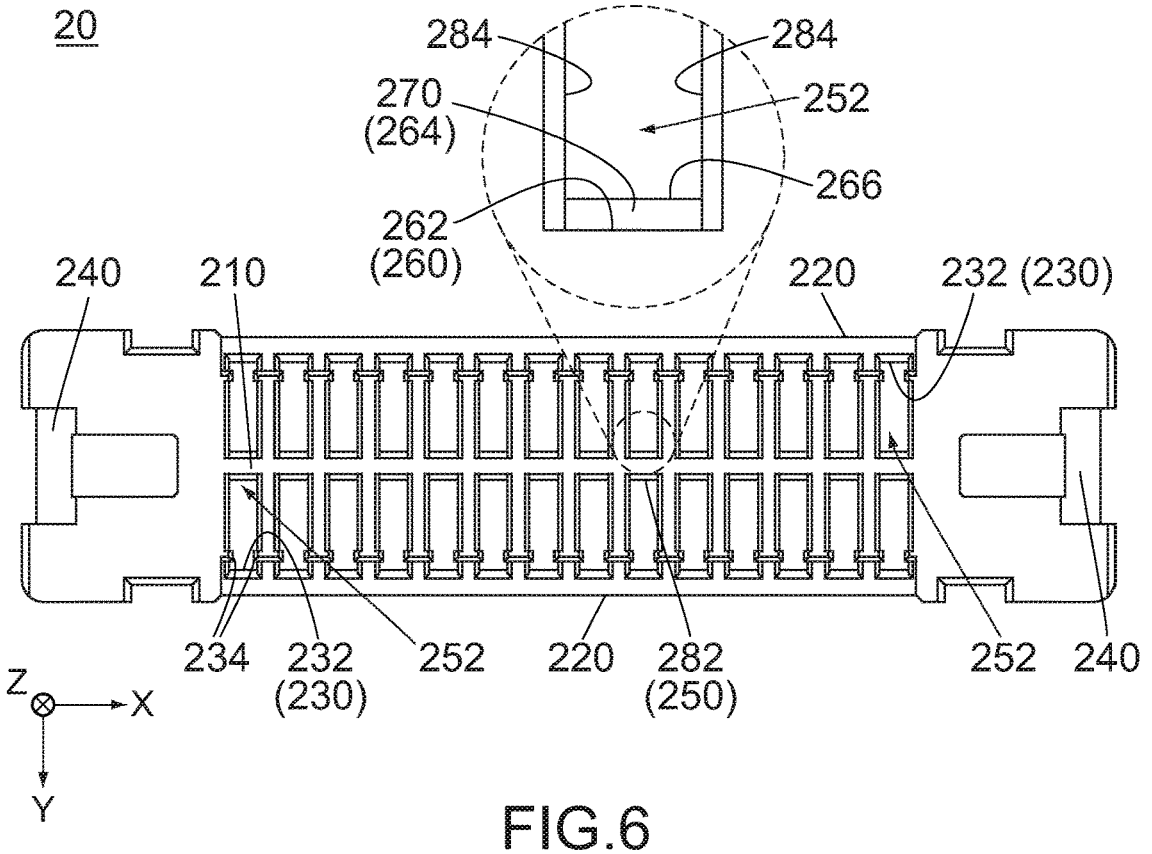
FIG. 6 is a bottom view showing the housing of FIG. 3, wherein a part of the housing enclosed by dashed line is enlarged to be illustrated.
Figure 7:
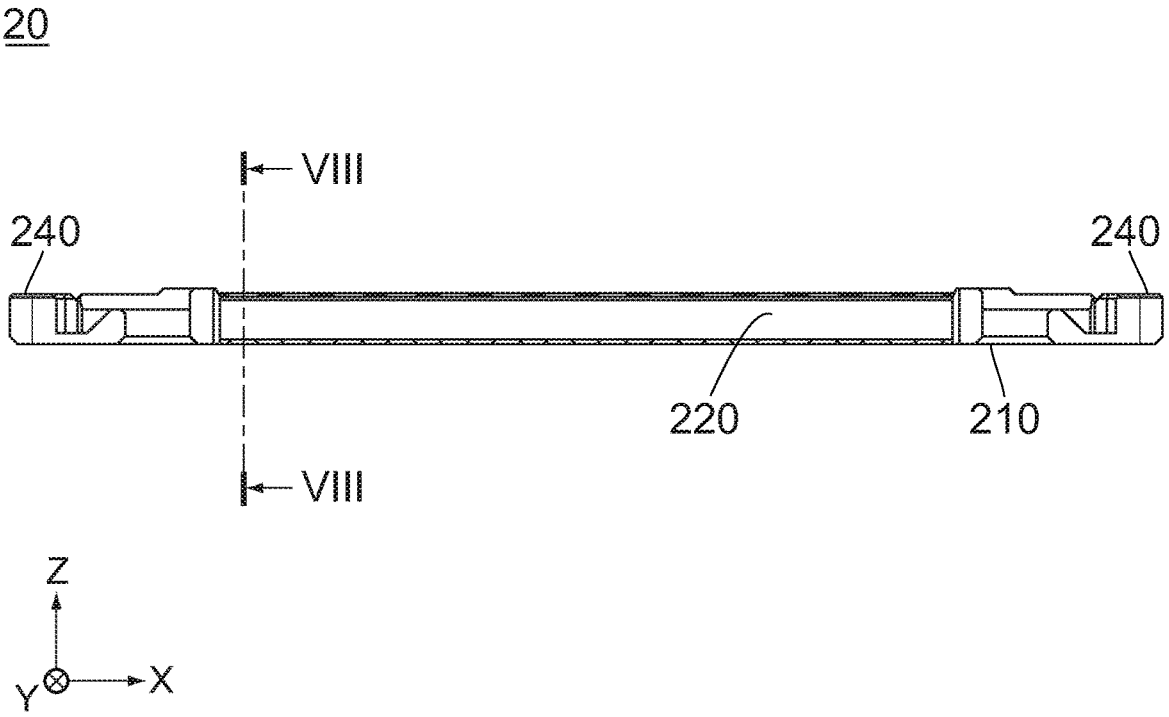
FIG. 7 is a side view showing the housing of FIG. 3.

As shown in FIGS. 3 and 5, the upstanding portion 250 has a middle wall 282 and a plurality of partition walls 284. The middle wall 282 is located between opposite ends of the upstanding portion 250 in the X-direction and extends linearly along the X-direction. The partition walls 284 are provided on opposite sides of the middle wall 282 in the Y-direction. On each side of the middle wall 282 in the Y-direction, two of the partition walls 284 are located at opposite ends of the middle wall 282 in the X-direction, respectively, and the remaining partition walls 284 are located at regular interval between the opposite ends in the X-direction. Each of the partition walls 284 extends from the middle wall 282 toward the holding portion 230, or outward in the Y-direction.

As shown in FIGS. 3 to 6, the upstanding portion 250 has a plurality of terminal-receiving portions 252. Each of the terminal-receiving portions 252 is a space which is located between two of the partition walls 284 adjacent to each other in the X-direction. The terminal-receiving portions 252 are provided so as to correspond to the holding grooves 232 of the holding portions 230, respectively. Each of the terminal-receiving portions 252 is located at a position same as that of the corresponding holding groove 232 in the X-direction. Each of the terminal-receiving portions 252 opens upward and downward in the Z-direction. In addition, a space between each of the holding grooves 232 and the corresponding terminal-receiving portion 252 opens upward and downward.

In the present embodiment, two rows of the terminal-receiving portions 252 are formed so as to correspond to the two holding portions 230, respectively. In each of the rows, the terminal-receiving portions 252 are arranged along the X-direction. However, the present invention is not limited thereto. For example, each of the rows may include only one of the terminal-receiving portions 252. Moreover, the terminal-receiving portions 252 may form a single row. In this case, the housing 20 may have only one of the two holding portions 230.

Figure 4:
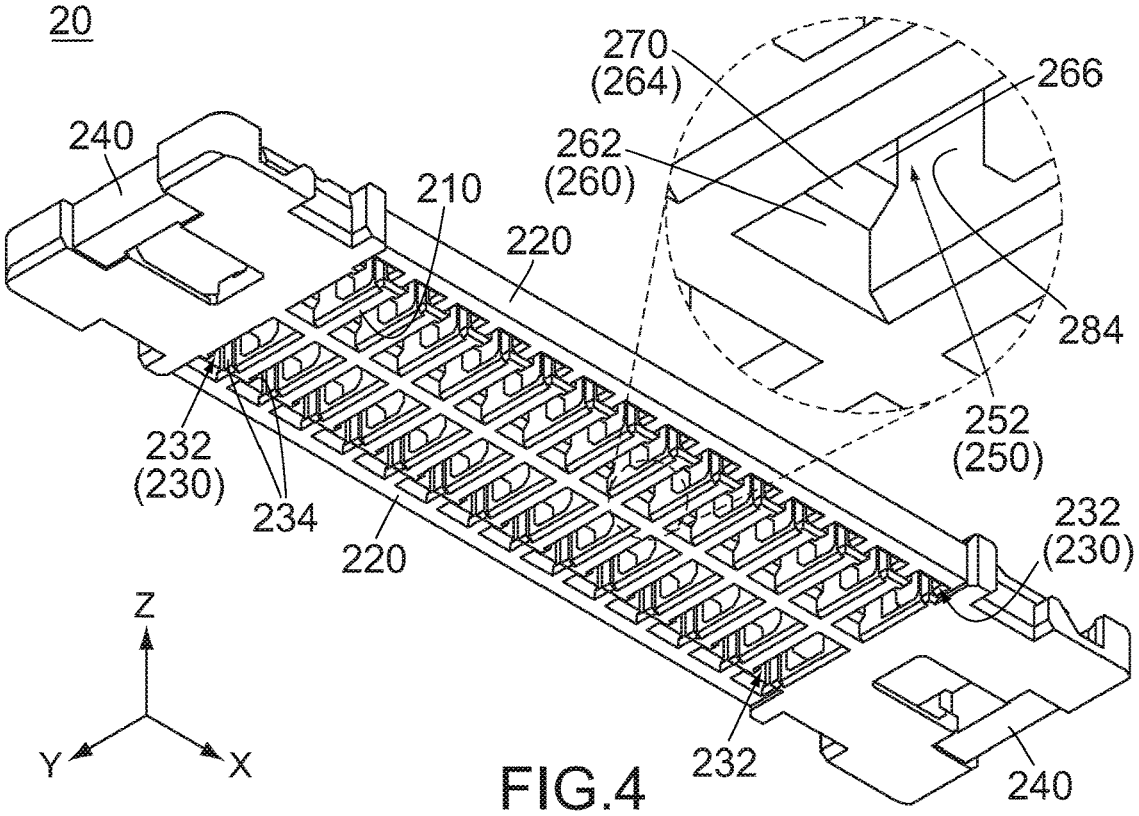
FIG. 4 is another perspective view showing the housing of FIG. 3, wherein a part of the housing enclosed by dashed line is enlarged to be illustrated.

Referring to FIGS. 3 and 4, the upstanding portion 250 has a plurality of facing walls 260. Each of the facing walls 260 is a part of the middle wall 282 and is located between two of the partition walls 284 adjacent to each other in the X-direction. Each of the facing walls 260 is located between two of the terminal-receiving portions 252 in the Y-direction.

Figure 8:
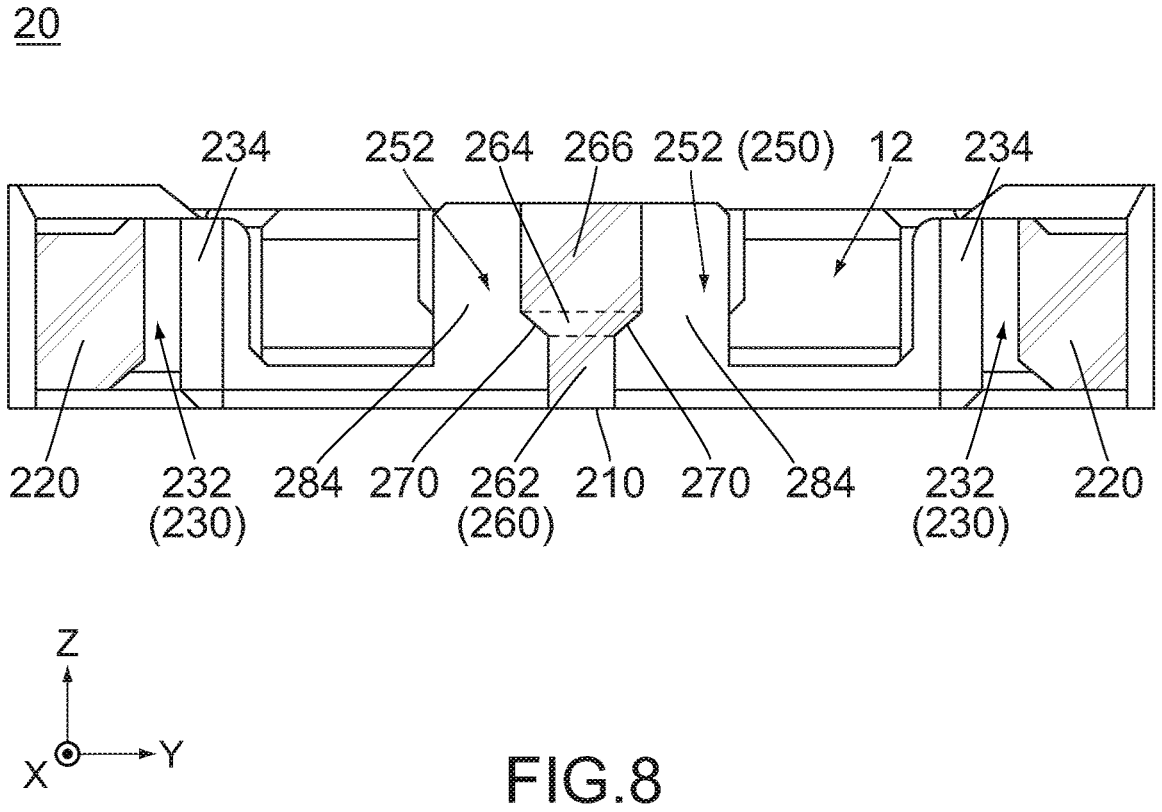
FIG. 8 is a cross-sectional view showing the housing of FIG. 7, taken along line VIII-VIII, wherein a boundary between an upper wall and the mid-wall and another boundary between a lower wall and the mid-wall are illustrated in dashed line.

As shown in FIG. 8, each of the facing walls 260 has a lower wall 262, a mid-wall 264 and an upper wall 266. The lower wall 262 extends upward from the bottom portion 210 of the housing 20 while having a constant width dimension in the Y-direction. The mid-wall 264 extends upward from an upper end, or the positive Z-side end, of the lower wall 262 while opposite sides thereof protrude in the Y-direction. The upper wall 266 extends upward from an upper end of the mid-wall 264 while having a constant width dimension in the Y-direction.

Referring to FIGS. 4 and 8, the upstanding portion 250 has a plurality of stop portions 270. According to the present embodiment, each of opposite sloping surfaces of each of the mid-walls 264 in the Y-direction works as the stop portion 270. However, the present invention is not limited thereto. For example, each of various parts of the facing wall 260 can be used as the stop portion 270 as described later. Moreover, the upstanding portion 250 may be provided with no partition wall 284, and the housing 20 may be provided with only one of the holding portions 230. In this case, the upstanding portion 250 may have only one stop portion that extends between the opposite ends of the upstanding portion 250 in the X-direction. Thus, the upstanding portion 250 may have at least one stop portion.

Referring to FIG. 1, in the present embodiment, the terminals 30 have shapes and sizes same as each other. In other words, the terminals 30 of the connector 10 are components same as each other. The present invention is not limited thereto, but the terminals 30 may have shapes and sizes different from each other to some extent. However, the present embodiment is preferable from a view point of reduction of types of components.

Referring to FIGS. 9 to 12, each of the terminals 30 is a single metal plate with bends. The present invention is not limited thereto, but each of the terminals 30 may be formed of a plurality of members.

Each of the terminals 30 has a fixed portion 310, a held portion 320, a coupling portion 330, a spring portion 340 and a contact portion 390. For each of the terminals 30, these portions are configured as described below.

The held portion 320 extends along the Z-direction and has two press-fit projections 322 which project opposite to each other in the X-direction. The fixed portion 310 extends outward in the Y-direction from a lower end of the held portion 320. The coupling portion 330 extends inward in the Y-direction from an upper end of the held portion 320. The spring portion 340 extends, as a whole, inward in the Y-direction from an inner end of the coupling portion 330 in the Y-direction to have a U-like shape. The contact portion 390 is supported by the spring portion 340.

Figure 9:
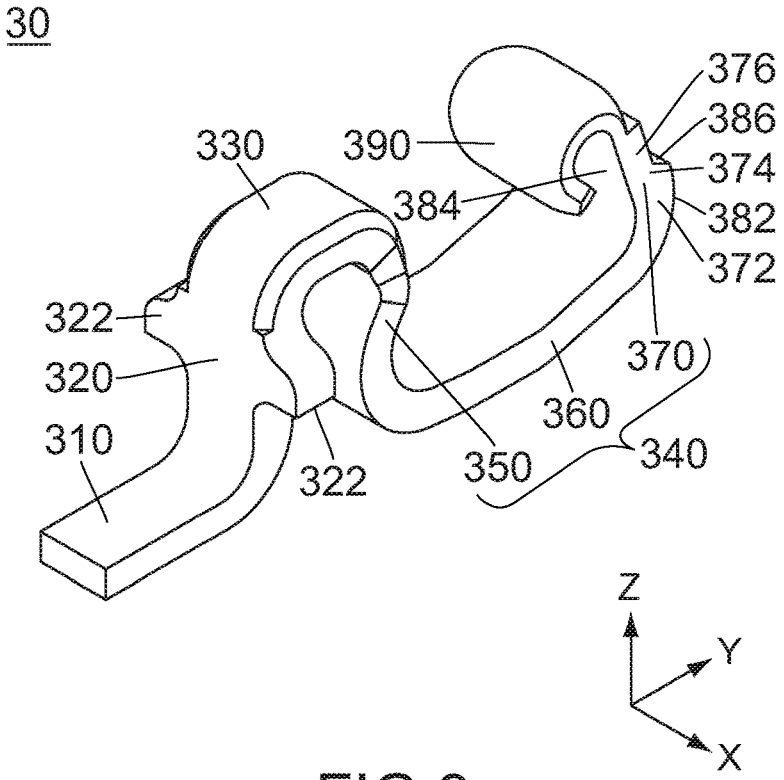
FIG. 9 is a perspective view showing one of terminals of the connector of FIG. 1.
Figure 10:
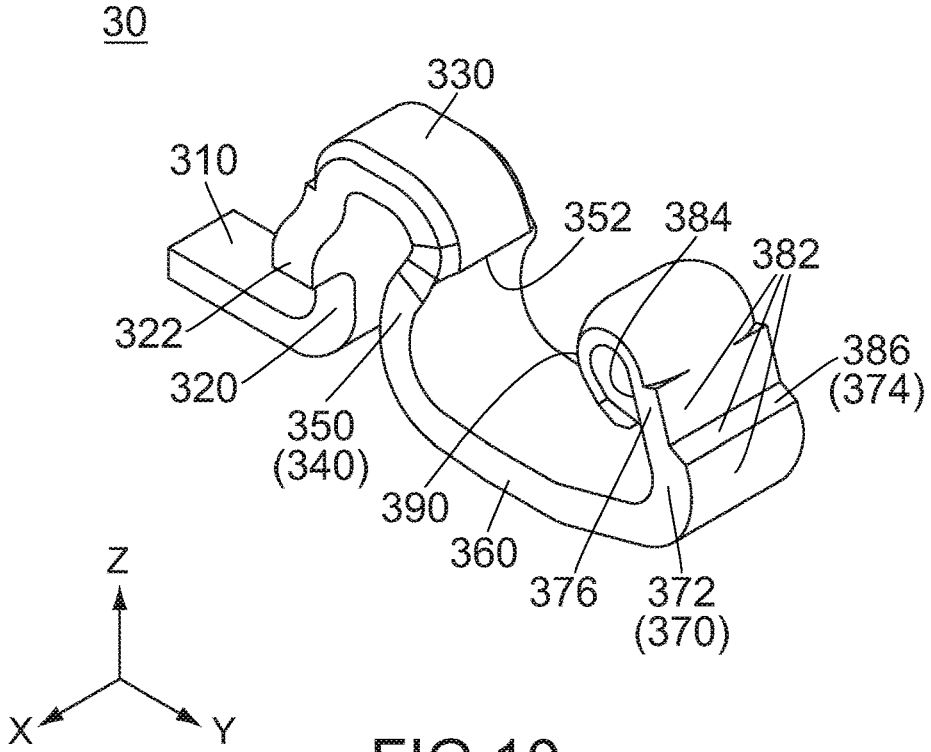
FIG. 10 is another perspective view showing the terminal of FIG. 9.
Figure 11:
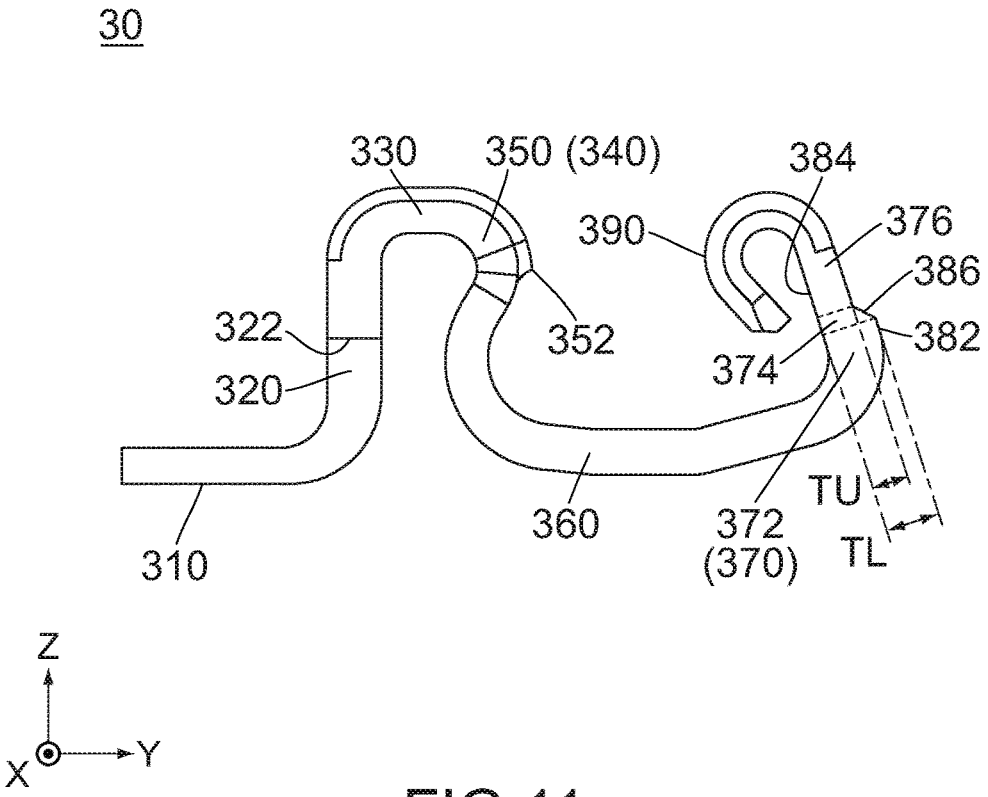
FIG. 11 is a side view showing the terminal of FIG. 9, wherein a boundary between an upper portion and a middle portion thereof and another boundary between a lower portion and the middle portion thereof are illustrated in dashed line.

Referring to FIGS. 9 to 11, the spring portion 340 has a downward extending portion 350, a base portion 360 and an upward extending portion 370. The downward extending portion 350 extends downward from the inner end of the coupling portion 330 in the Y-direction and has a contact point 352 which protrudes inward in the Y-direction. The base portion 360 extends inward in the Y-direction from a lower end of the downward extending portion 350. The upward extending portion 370 extends upward from an inner end of the base portion 360 in the Y-direction. The upward extending portion 370 has a lower portion 372, a middle portion 374 and an upper portion 376. The lower portion 372 extends upward from the inner end of the base portion 360 in the Y-direction. The middle portion 374 extends upward from an upper end of the lower portion 372. The upper portion 376 extends upward from an upper end of the middle portion 374 and subsequently extends downward while protruding outward in the Y-direction so that the contact portion 390 is formed.

The spring portion 340, which is formed as described above, is resiliently deformable in the YZ-plane. The contact portion 390 is supported by the upward extending portion 370 and is movable mainly in the Y-direction. In the present embodiment, the spring portion 340 extends from the held portion 320 via the coupling portion 330. However, the present invention is not limited thereto. For example, the spring portion 340 may extend directly from the held portion 320. Instead, the spring portion 340 may extend indirectly from the held portion 320 via some portion and the coupling portion 330.

Figure 12:
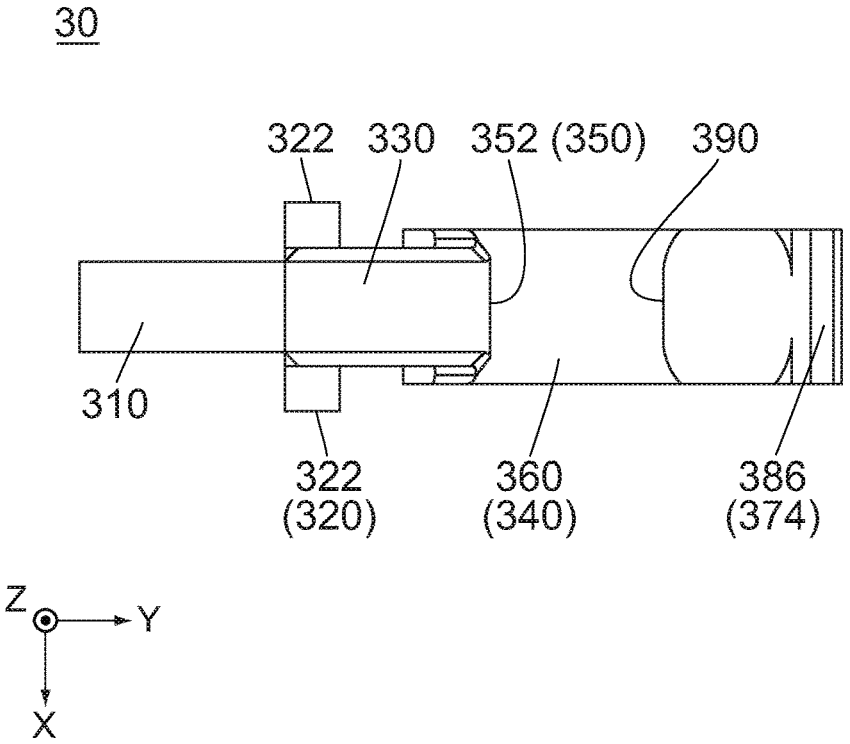
FIG. 12 is a top view showing the terminal of FIG. 9.

Referring to FIG. 12, in the present embodiment, a width dimension of the spring portion 340 in the X-direction is almost constant. The present invention is not limited thereto. For example, the spring portion 340 may be provided with a portion projecting in the X-direction. However, the present embodiment is preferable from a view point of uniform and resilient deformation of the entire spring portion 340.

Referring to FIGS. 9 to 11, the upward extending portion 370 has a facing portion 382 and an opposite portion 384. The facing portion 382 and the opposite portion 384 are located at opposite sides of the upward extending portion 370 in the Y-direction, respectively. In other words, the opposite portion 384 is located opposite to the facing portion 382 in the Y-direction. More specifically, in the present embodiment, the facing portion 382 is an inner surface (facing surface) of the upward extending portion 370 in the Y-direction, and the opposite portion 384 is an outer surface (opposite surface) of the upward extending portion 370 in the Y-direction. However, the present invention is not limited thereto. For example, each of the facing portion 382 and the opposite portion 384 may be a linearly extending edge formed on the upward extending portion 370.

The facing portion 382 has a stopped portion 386. The upper portion 376 extends upward from the stopped portion 386, and the lower portion 372 extends downward from the stopped portion 386. Referring to FIG. 11, in a predetermined plane (YZ-plane) defined by the Y-direction and the Z-direction, a thickness dimension TU of the upper portion 376 is smaller than another thickness dimension TL of the lower portion 372 in the predetermined plane. Thus, the facing portion 382 protrudes inward in the Y-direction at the middle portion 374 to form the stopped portion 386.

According to the present embodiment, the middle portion 374 is formed with a protruding surface which works as the stopped portion 386. However, the present invention is not limited thereto. For example, the thickness dimension TU of the upper portion 376 may be equal to the thickness dimension TL of the lower portion 372. In addition, the middle portion 374 may be oblique to each of the upper portion 376 and the lower portion 372 in the YZ-plane. According to this structure, a sloping upper surface, or the positive Z-side surface, of the middle portion 374 works as the stopped portion 386. Moreover, as described later, various parts of the upward extending portion 370 can be used as the stopped portion 386.

Figure 13:
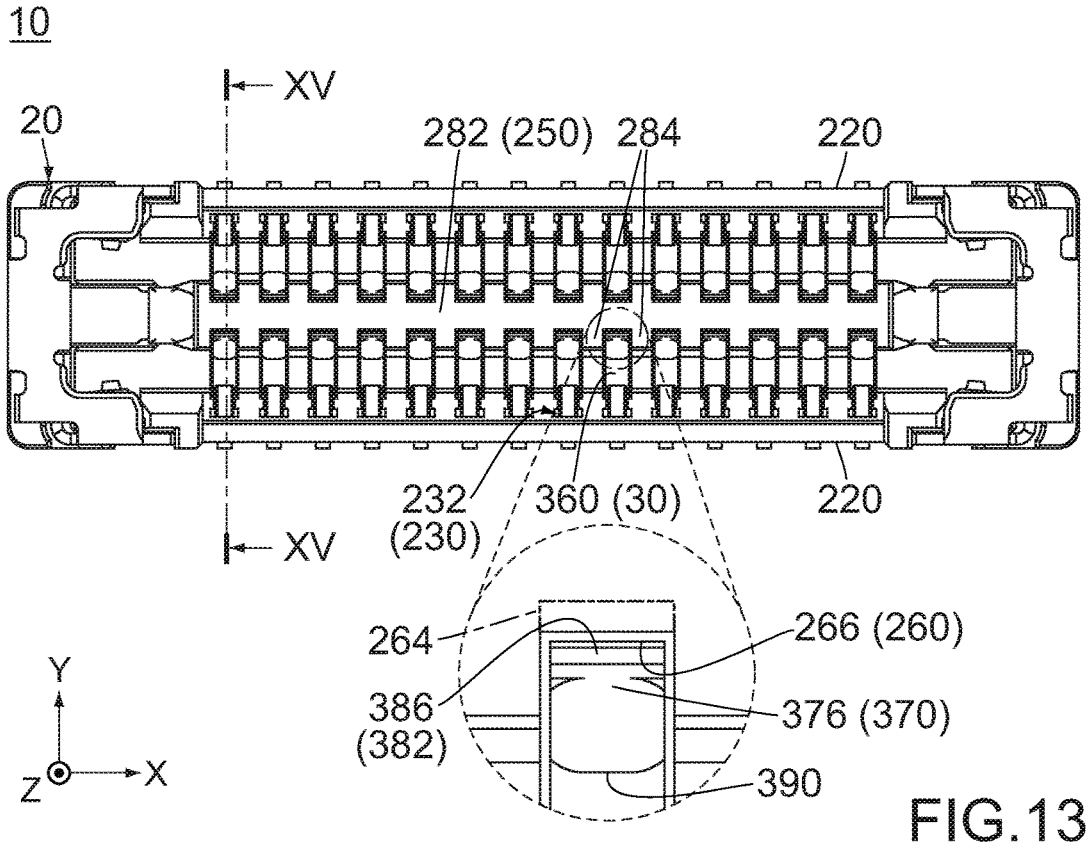
FIG. 13 is a top view showing the connector of FIG. 1, wherein a part of the connector enclosed by dashed line is enlarged to be illustrated, and in the enlarged view, an outline of the hidden mid-wall is illustrated in chain dotted line.
Figure 14:
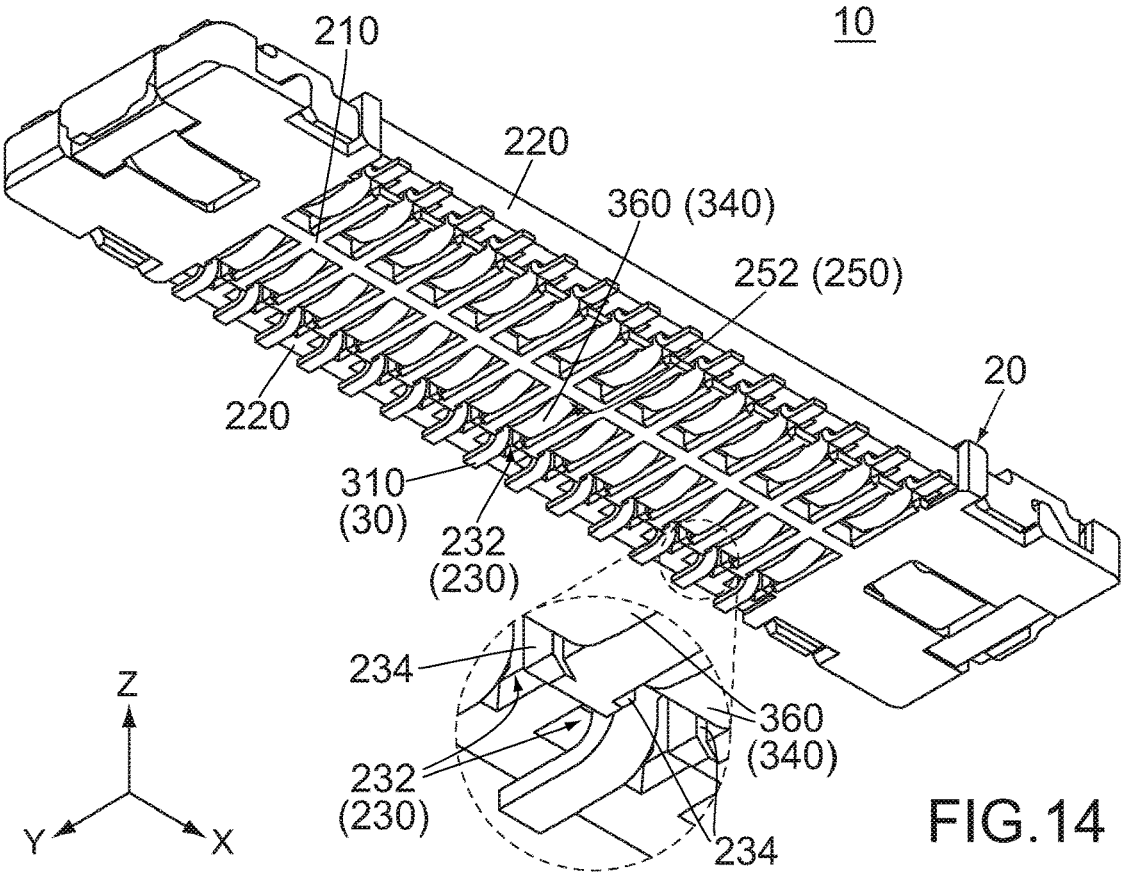
FIG. 14 is a perspective view showing the connector of FIG. 13, wherein a part of the connector enclosed by dashed line is enlarged to be illustrated.
Figure 15:
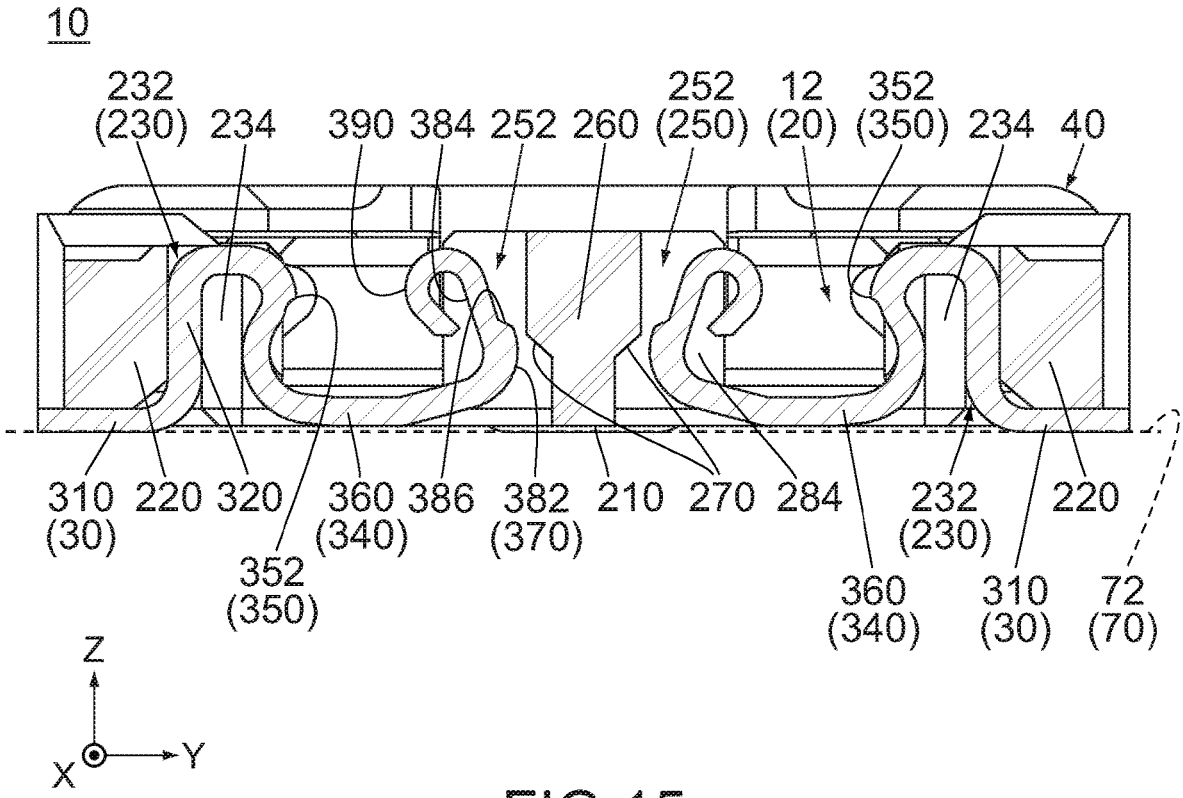
FIG. 15 is a cross-sectional view showing the connector of FIG. 13, taken along line XV-XV, wherein the connector is mounted on a principal surface of a circuit board, and an outline of a part of the principal surface is illustrated in dashed-line.
Figure 16:
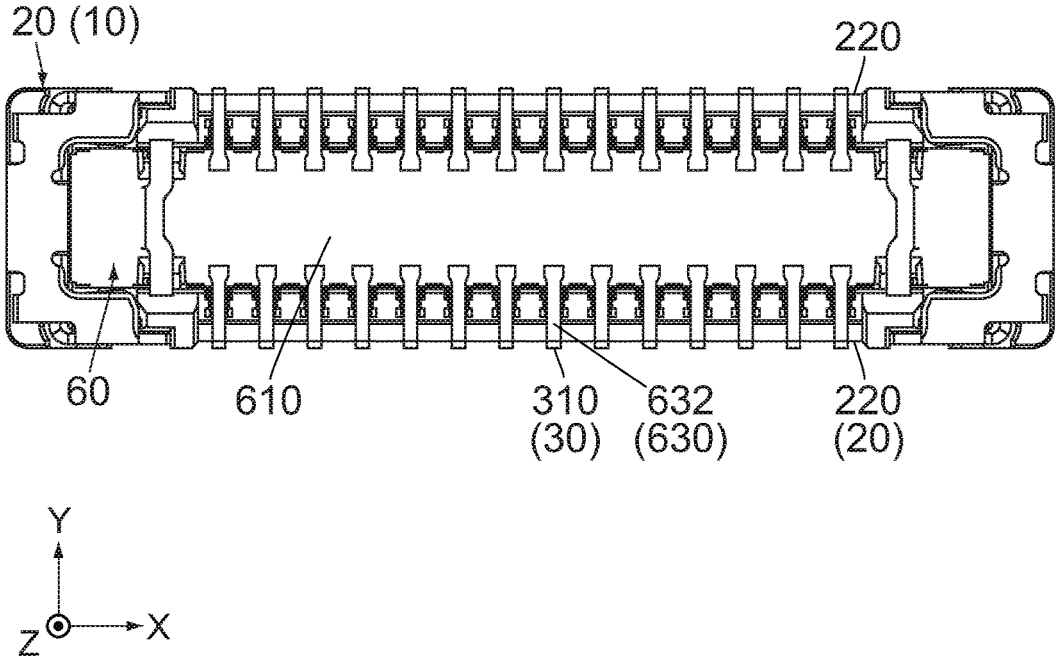
FIG. 16 is a top view showing the connector and the mating connector of FIG. 1, wherein the connector is mated with the mating connector.

Referring to FIGS. 13 and 14, each of the holding portions 230 of the housing 20 holds the terminals 30 which are arranged along the X-direction. In detail, the holding grooves 232 of the holding portions 230 are provided so as to correspond to the terminals 30, respectively. Each of the terminals 30 is attached to the housing 20 from below so that the held portion 320 thereof is press-fit into the corresponding holding groove 232. Thus, the held portion 320 of each of the terminals 30 is held by the corresponding holding portion 230. Referring to FIGS. 14 and 15, for each of the thus-attached terminals 30, the downward extending portion 350 is in contact with inner surfaces of the corresponding stop walls 234 in the Y-direction, so that the contact point 352 is hardly moved outward in the Y-direction.

In the present embodiment, the terminals 30 are attached to the housing 20 as described above. The terminals 30 are separated into two rows and are arranged in the X-direction. The terminals 30 of one of the rows are arranged so as to be mirror-symmetrical to the terminals 30 of a remaining one of the rows with respect to the XZ-plane. The base portion 360 of each of the terminals 30 exposed downward from the housing 20. Moreover, the fixed portion 310 of each of the terminals 30 passes under the corresponding sidewall 220 of the housing 20 in the Y-direction to extend outward of the housing 20 in the Y-direction.

In the present embodiment, the sidewalls 220 are located over the fixed portions 310 and cover, at least in part, each of the fixed portions 310 when the connector 10 is seen from above along the Z-direction. In other words, the sidewalls 220 partially cover each of the fixed portions 310 from above. However, the present invention is not limited thereto. For example, each of the terminals 30 may be attached to the housing 20 from above. In this case, each of the fixed portions 310 may be entirely exposed upward. Instead, the sidewalls 220 may entirely cover each of the fixed portions 310 from above.

Figure 19:
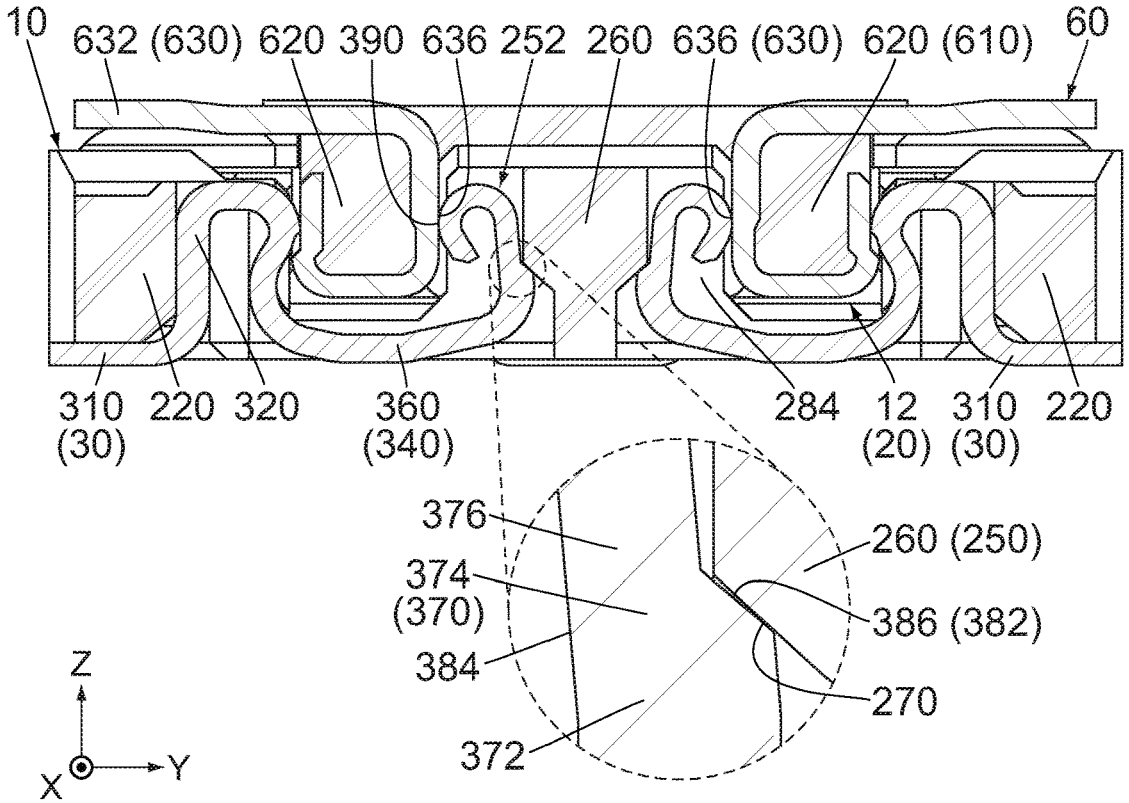
FIG. 19 is a cross-sectional view showing the connector and the mating connector of FIG. 18, wherein the mating connector is in a process of being removed from the connector, and a part of the connector enclosed by dashed line is enlarged to be illustrated.

Referring to FIGS. 15, 18 and 19, under a state where the connector 10 is mounted on the principal surface 72 of the circuit board 70, each of the terminals 30 is arranged as described below.

Referring to FIG. 15, for each of the terminals 30, the facing portion 382 is located inside the terminal-receiving portion 252. In contrast, the contact portion 390 projects into the inside of the receiving portion 12. The stopped portion 386 of the facing portion 382 can be moved inside the receiving portion 12 in the Y-direction in accordance with the movement of the contact portion 390.

Referring to FIG. 15, when the connector 10 is mounted on the principal surface 72 of the circuit board 70, the fixed portion 310 is fixed to a conductive pad (not shown) of the principal surface 72 via soldering, etc. Under an unmated state where the connector 10 is not mated with the mating connector 60 (see FIG. 1), the spring portion 340 of the terminal 30 is apart from the housing 20 and the principal surface 72, and the whole of the spring portion 340 except a part of the downward extending portion 350 is resiliently deformable.

Referring to FIG. 18, under a mated state where the connector 10 and the mating connector 60 are mated with each other, the spring portion 340 of the terminal 30 is resiliently deformed, and the contact portion 390 is brought into contact with the mating contact portion 636 of the mating terminal 630. As a result, the connector 10 is electrically connected with the mating connector 60. According to the present embodiment, under the mated state, the mating contact portion 636 is sandwiched between the contact point 352 and the contact portion 390 and is brought into contact with each of the contact point 352 and the contact portion 390. The present invention is not limited thereto, but the terminal 30 does not need to have the contact point 352. According to this structure, under the mated state, the mating contact portion 636 is brought into contact only with the contact portion 390. However, the present embodiment is preferable from a view point of secure connection of the connector 10 with the mating connector 60.

Referring to FIG. 15, under the unmated state, the facing portion 382 of the terminal 30 is apart from the facing wall 260 of the upstanding portion 250 in the Y-direction and faces the facing wall 260 in the Y-direction. Referring to FIG. 18, under the mated state, the contact portion 390 of the terminal 30 is pressed by the mating terminal 630 to be moved inward in the Y-direction. The stopped portion 386 of the facing portion 382 is moved toward the facing wall 260 in accordance with the movement of the contact portion 390. As a result, under the mated state, the stop portion 270 is located above the stopped portion 386 of the terminal 30 and faces the stopped portion 386 in the Z-direction.

Referring to FIG. 19, while the mating connector 60 is removed from the connector 10, the terminal 30 receives an upward force (removal force) from the mating terminal 630 of the mating connector 60. This removal force moves the stopped portion 386 upward. The thus-moved stopped portion 386 is brought into abutment with the stop portion 270 which faces the stopped portion 386, so that the spring portion 340 is not resiliently deformed any further. Thus, plastic deformation of the terminal 30 is prevented.

In detail, in the present embodiment, the fixed portion 310 is covered by the sidewall 220 from above. Therefore, even if the removal force applied to the terminal 30 is large, the terminal 30 hardly comes off from the housing 20. However, in a case where a portion such as the stopped portion 386 and the stop portion 270, which restricts resilient deformation of the spring portion 340, is not provided, the spring portion 340 might be pulled upward and largely stretched because of the removal force, so that the spring portion 340 might be plastically deformed. According to the present embodiment, such plastic deformation is prevented. Moreover, even in a structure (not shown) where the fixed portion 310 is entirely exposed upward, the stopped portion 386 is brought into abutment with the stop portion 270, so that coming-off of the terminal 30 is prevented.

According to the present invention, while the mating connector 60 is removed, it is unnecessary to move the stopped portion 386 in a direction perpendicular to the Z-direction. Moreover, referring to FIGS. 15 and 18, it is easy to move the stopped portion 386 inward in the Y-direction under the mated state. For example, a distance between the contact point 352 and the contact portion 390 of the terminal 30 in the Y-direction under the unmated state may be formed to be smaller than a size of the peripheral wall 620 in the Y-direction, in which the mating contact portion 636 is embedded. Forming the terminal 30 as described above makes it easy to move the stopped portion 386 inward in the Y-direction and to arrange the stopped portion 386 so that the stopped portion 386 faces the stop portion 270 in the Z-direction under the mated state even if there are some manufacturing variations. Thus, the present invention provides the connector 10 having a mechanism which prevents coming-off and plastic deformation of the terminal 30 while allowing manufacturing variation.

According to the present embodiment, since the contact point 352 is hardly moved outward in the Y-direction, the stopped portion 386 is reliably moved inward in the Y-direction under the mated state. However, the present invention is not limited thereto, but the contact point 352 may be moved outward in the Y-direction to some extent.

Referring to FIG. 15, according to the present embodiment, the upward extending portion 370 of the terminal 30 has a part that protrudes toward the facing wall 260 of the upstanding portion 250 in the Y-direction to form the stopped portion 386. The stopped portion 386 is a sloping surface which intersects with both the Y-direction and the Z-direction. The stop portion 270 is another sloping surface which similarly intersects with both the Y-direction and the Z-direction. Referring to FIGS. 15 and 18, the stopped portion 386 slopes so as to correspond to the stop portion 270. In detail, the stopped portion 386 extends toward the upstanding portion 250 in the Y-direction while sloping downward. The stop portion 270 extends toward the holding portion 230 in the Y-direction while sloping upward.

Since the stop portion 270 and the stopped portion 386 of the present embodiment have the aforementioned structure, the stopped portion 386 is smoothly moved to be located below the stop portion 270 under the mated state. In addition, referring to FIG. 19, while the mating connector 60 is removed from the connector 10, the stopped portion 386 is reliably brought into abutment with the stop portion 270. However, the present invention is not limited thereto. For example, the stop portion 270 may be a horizontal surface perpendicular to the Z-direction. Moreover, the structure of the stop portion 270 and the stopped portion 386 can be modified as described later, for example.

Referring to FIGS. 15 and 18, according to the present embodiment, in each of the unmated state and the mated state, the stopped portion 386 is apart from the stop portion 270. This structure prevents degradation of spring property which might be caused by abutment of the stopped portion 386 with the stop portion 270. However, the present invention is not limited thereto. For example, the stopped portion 386 may be in contact with the stop portion 270 under the mated state.

Referring to FIG. 15, according to the present embodiment, the upstanding portion 250 does not need to be provided with a portion that covers the stopped portions 386 from above under the unmated state. Therefore, the connector 10 can be reduced in its height while the spring length of the spring portion 340 is lengthened. Referring to FIG. 17, a distance between the principal surface 72 of the circuit board 70 and the mating principal surface 82 of the mating circuit board 80 can be made short under the mated state.

The present embodiment can be variously modified in addition to the already explained modifications, for example, as described below.

Figure 20:
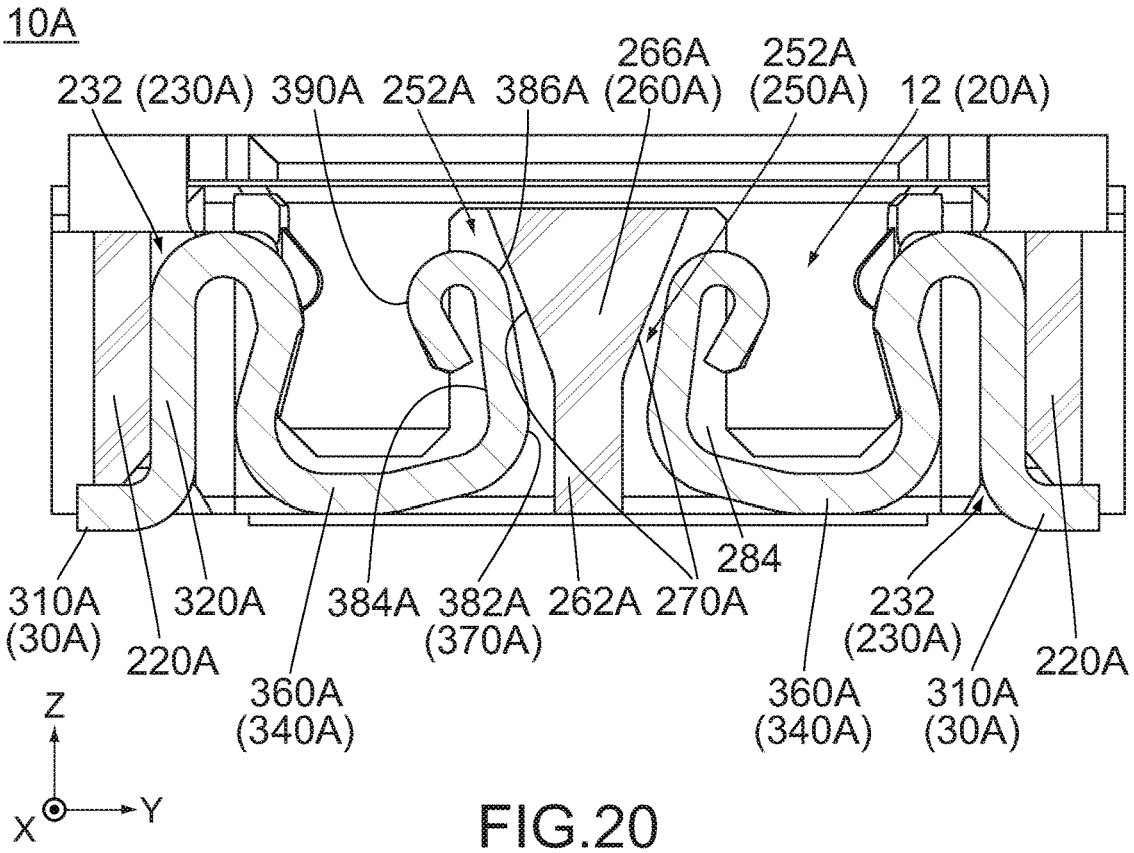
FIG. 20 is a cross-sectional view showing a modification of the connector of FIG. 15.
Figure 21:
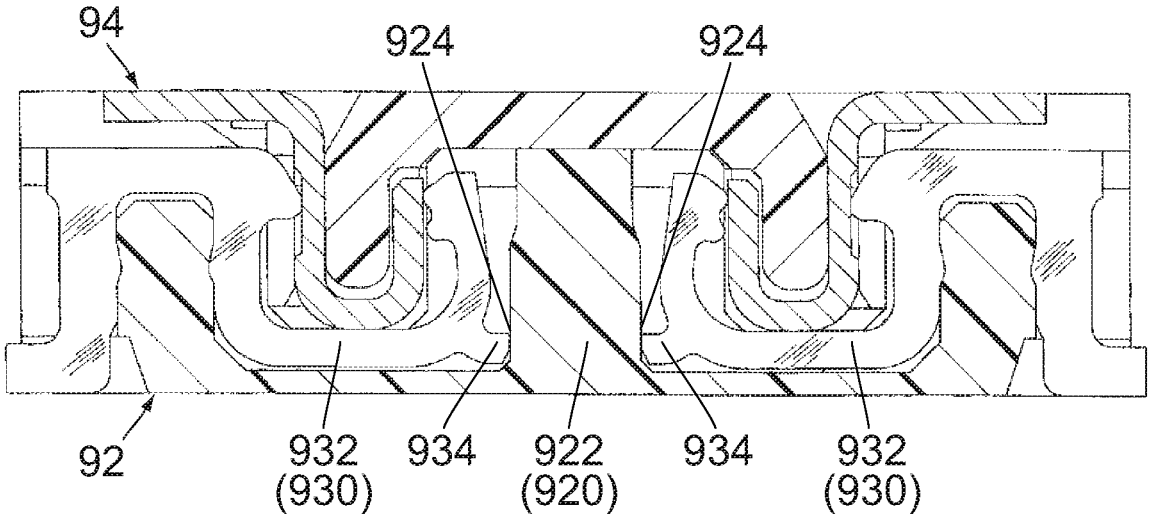
FIG.21 PRIOR ART
FIG. 21 is a cross-sectional view showing a connector and a mating connector of Patent Document 1.
Figure 22:
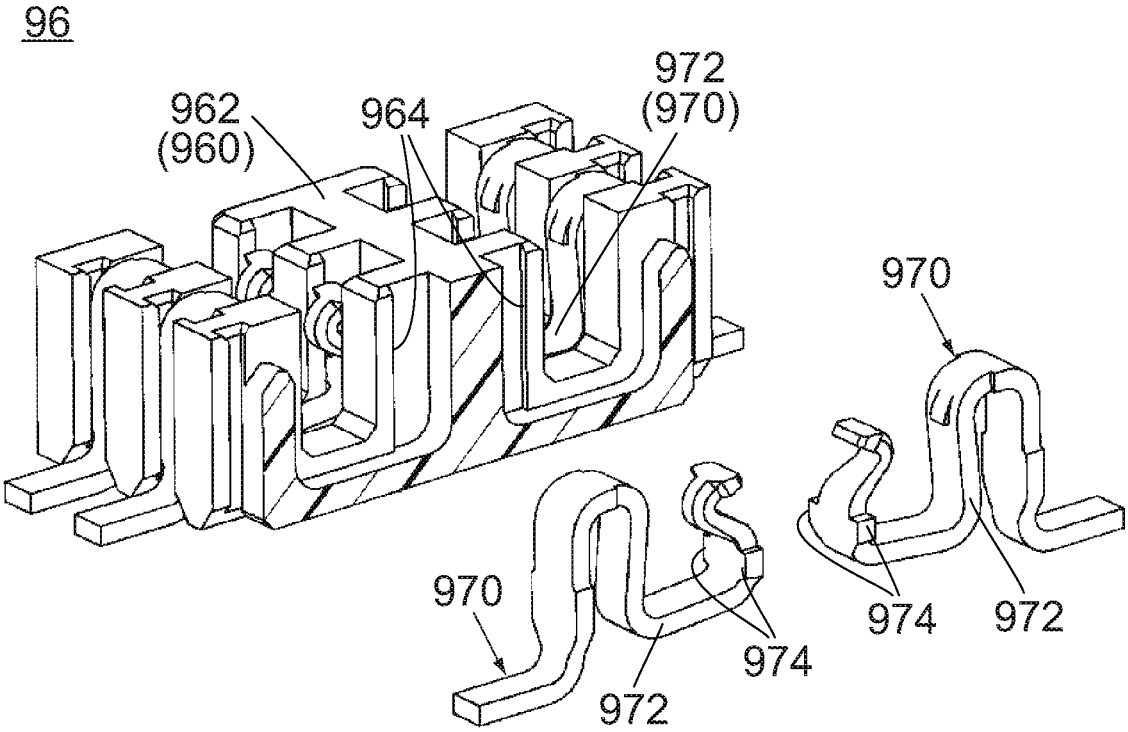
FIG.22 PRIOR ART
FIG. 22 is a partially cut-away, perspective view showing a connector of Patent Document 2 together with two terminals thereof.
Figure 23:
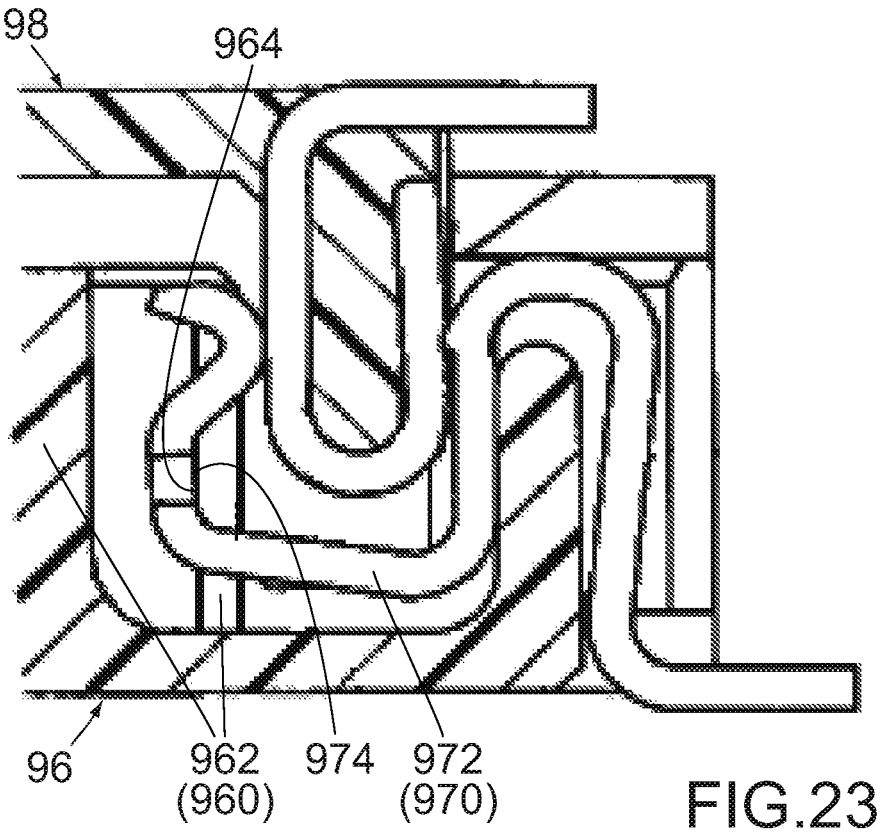
FIG.23 PRIOR ART
FIG. 23 is a cross-sectional view showing the connector and a mating connector of Patent Document 2.

Referring to FIG. 20, a connector 10A according to a modification comprises a housing 20A made of insulator and a plurality of terminals 30A each made of conductor.

The housing 20A has a structure similar to that of the housing 20 (see FIG. 3). For example, the housing 20A has two sidewalls 220A, two holding portions 230A and an upstanding portion 250A. The two sidewalls 220A extend in parallel to each other along the X-direction. The holding portions 230A are provided so as to correspond to the sidewalls 220A, respectively. Each of the holding portions 230A is formed with a plurality of the holding grooves 232. The upstanding portion 250A is located at the middle of the housing 20A in the Y-direction and extends along the X-direction.

The housing 20A has a plurality of terminal-receiving portions 252A which are formed similar to the terminal-receiving portions 252 (see FIG. 3) of the housing 20 (see FIG. 3). The upstanding portion 250A has a plurality of facing walls 260A which are formed similar to the facing walls 260 of the housing 20 (see FIG. 3). Each of the facing walls 260A has a lower wall 262A and an upper wall 266A but has no mid-wall 264 (see FIG. 8) unlike the facing wall 260. The lower wall 262A extends upward from a lower end of the housing 20A while having a constant width dimension in the Y-direction. The upper wall 266A extends upward from an upper end of the lower wall 262A while opposite sides thereof protrude in the Y-direction.

The upstanding portion 250A which is formed as described above has a plurality of stop portions 270A. In the present modification, each of opposite sloping surfaces of the upper wall 266A in the Y-direction works as the stop portion 270A.

Each of the terminals 30A has a structure similar to that of the terminal 30 (see FIG. 9). More specifically, each of the terminals 30A has a fixed portion 310A, a held portion 320A, a spring portion 340A and a contact portion 390A. The held portion 320A extends along the Z-direction. The fixed portion 310A extends outward in the Y-direction from a lower end of the held portion 320A. The spring portion 340A extends, as a whole, inward in the Y-direction from an upper end of the held portion 320A while having a U-like shape. The contact portion 390A is supported by the spring portion 340A.

The spring portion 340A has a base portion 360A and an upward extending portion 370A similar to the spring portion 340 (see FIG. 9) of the terminal 30 (see FIG. 9). The upward extending portion 370A extends upward from an inner end of the base portion 360A in the Y-direction. The upward extending portion 370A has an upper portion that extends upward and subsequently extends downward while protruding outward in the Y-direction so that the contact portion 390A is formed.

Each of the holding portions 230A of the housing 20A holds the terminals 30A which are arranged in the X-direction. The base portion 360A of each of the terminals 30A is exposed downward from the housing 20A. The sidewalls 220A cover each of the fixed portions 310A from above. Under the unmated state where the connector 10A is not mated with a mating connector (not shown), the whole of the spring portion 340A of each of the terminals 30A is resiliently deformable.

For each of the terminals 30A, the upward extending portion 370A has a facing portion 382A and an opposite portion 384A. The facing portion 382A faces the facing wall 260A of the upstanding portion 250A in the Y-direction, and the opposite portion 384A is located opposite to the facing portion 382A in the Y-direction. The facing portion 382A has a stopped portion 386A. In the present modification, a part of the facing portion 382A that is located in the vicinity of an upper end thereof works as the stopped portion 386A.

In the present modification, the stopped portion 386A is smoothly moved to be located below the stop portion 270A under the mated state (not shown). Thus, under the mated state, the stop portion 270A is located above the stopped portion 386A and faces the stopped portion 386A in the Z-direction. While the mating connector (not shown) is removed from the connector 10A, the terminal 30A receives an upward force (removal force) from the mating connector. This removal force moves the stopped portion 386A upward. The thus-moved stopped portion 386A is brought into abutment with the stop portion 270A which faces the stopped portion 386A, so that plastic deformation of the terminal 30A is prevented.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector along an upper-lower direction, wherein:

the connector comprises a housing and a plurality of terminals;

the housing has a holding portion and an upstanding portion;

the holding portion holds the terminals which are arranged along a first direction perpendicular to the upper-lower direction;

the holding portion and the upstanding portion are apart from each other in a second direction perpendicular to both the upper-lower direction and the first direction;

the upstanding portion has at least one stop portion;

each of the terminals has a held portion, a spring portion and a contact portion;

each of the held portions is held by the holding portion;

for each of the terminals, the spring portion extends from the held portion and has a base portion and an upward extending portion;

for each of the terminals, the upward extending portion extends upward from the base portion;

for each of the terminals, the contact portion is supported by the upward extending portion;

each of the upward extending portions has a facing portion and an opposite portion;

each of the facing portions faces the upstanding portion in the second direction and has a stopped portion;

for each of the terminals, the opposite portion is located opposite to the facing portion in the second direction;

under a mated state where the connector and the mating connector are mated with each other, the at least one stop portion is located above the stopped portions and faces the stopped portions in the upper-lower direction;

each of the upward extending portions has an upper end that is an uppermost part thereof in the upper-lower direction;

the upper end of each of the upward extending portions is located outside of the upstanding portion in the second direction in an unmated state in which the connector is not mated with the mating connector; and under the unmated state, each of the stopped portions is located entirely outward of the at least one stop portion in the second direction.

2. The connector as recited in claim 1, wherein:

each of the upward extending portions has an upper portion and a lower portion;

for each of the terminals, the upper portion extends upward from the stopped portion, and the lower portion extends downward from the stopped portion; and for each of the terminals, in a plane defined by the upper-lower direction and the second direction, a thickness dimension of the upper portion is smaller than a thickness dimension of the lower portion.

3. The connector as recited in claim 1, wherein under the mated state, the stopped portions are apart from the at least one stop portion.

4. The connector as recited in claim 1, wherein:

each of the terminals has a fixed portion which is to be fixed to a circuit board;

the housing has a sidewall; and the sidewall is located over the fixed portions and covers, at least in part, each of the fixed portions when the connector is seen from above along the upper-lower direction.

5. The connector as recited in claim 1, wherein:

each of the upward extending portions has a part that protrudes toward the upstanding portion to form the stopped portion; and each of the stopped portions intersects with both the upper-lower direction and the second direction.

6. The connector as recited in claim 5, wherein each of the stopped portions extends toward the upstanding portion in the second direction while sloping downward.

7. The connector as recited in claim 1, wherein the at least one stop portion intersects with both the upper-lower direction and the second direction.

8. The connector as recited in claim 7, wherein the at least one stop portion extends toward the holding portion in the second direction while sloping upward.

* * * * *